US008499424B2

(12) United States Patent
Chen

(10) Patent No.: US 8,499,424 B2
(45) Date of Patent: Aug. 6, 2013

(54) BINDING ASSEMBLY

(75) Inventor: Yi-Liang Chen, Taichung (TW)

(73) Assignee: Jin Jiang City, Shoes-Lock Co., Ltd., Fu Jian Province (CN)

( * ) Notice: Subject to any disclaimer, the term of this patent is extended or adjusted under 35 U.S.C. 154(b) by 23 days.

(21) Appl. No.: 13/302,365

(22) Filed: Nov. 22, 2011

(65) Prior Publication Data

US 2013/0125356 A1 May 23, 2013

(51) Int. Cl.
*A43C 7/00* (2006.01)
*A43C 11/00* (2006.01)

(52) U.S. Cl.
USPC ..... 24/712.5; 24/712.7

(58) Field of Classification Search
USPC ..... 24/712.1–712.3, 712.5–712.7, 712, 24/712.4, 712.8–712.9
See application file for complete search history.

(56) References Cited

U.S. PATENT DOCUMENTS 6,718,602 B1 * 4/2004 Chang ..... 24/712.1
6,779,281 B1 * 8/2004 Liu ..... 36/50.1
6,782,588 B1 * 8/2004 Liu ..... 24/712.5
6,796,009 B1 * 9/2004 Liu ..... 24/712.6
6,817,070 B1 * 11/2004 Liu ..... 24/712.5
6,839,944 B1 * 1/2005 Liu ..... 24/712.1
6,938,307 B2 * 9/2005 Liu ..... 24/712.5
7,036,193 B1 * 5/2006 Liu ..... 24/712
7,313,849 B2 * 1/2008 Liu ..... 24/712.5
7,657,980 B2 * 2/2010 Liu ..... 24/712.5
7,681,289 B2 * 3/2010 Liu ..... 24/712.5
2009/0193634 A1 * 8/2009 Liu ..... 24/712.5

* cited by examiner

*Primary Examiner* — Robert J Sandy
*Assistant Examiner* — Abigail E Morrell
(74) *Attorney, Agent, or Firm* — William E. Pelton, Esq.; Cooper & Dunham LLP

(57) ABSTRACT

A binding assembly has a binding frame, a pulling tie and a tightening tie. The binding frame has a base, a pressing member, two tie fastening holders and two separating members. The tie fastening holders are connected pivotally to the base and each has a pulling tie hole and a tightening tie hole. Each separating member divides the corresponding tightening tie hole into a first hole segment and a second hole segment. The pulling tie is mounted through and compressed by the pressing member and has two ends mounted respectively through the pulling tie holes. The tightening tie has two ends mounted respectively through the first hole segments along a first direction, mounted respectively over the separating members and mounted respectively through the second hole segments along a second direction opposite to the first direction.

6 Claims, 11 Drawing Sheets

BINDING ASSEMBLY

BACKGROUND OF THE INVENTION

1. Field of the Invention

The present invention relates to a binding assembly, and more particularly to a binding assembly that can be tightened or released easily and rapidly.

2. Description of Related Art

A tie is always applied to bind an object, such as a shoe. To bind a shoe with a tie, the tie is tied into a bow, but to tie a bow is difficult for a child or a disable person. The conventional bow tied by a child or a disable person is easily released to cause inconvenience during the use of the object.

To overcome the shortcomings, the present invention tends to provide a binding assembly to mitigate or obviate the aforementioned problems.

SUMMARY OF THE INVENTION

The main objective of the invention is to provide a binding assembly that can be tightened or released easily and rapidly.

The binding assembly has a binding frame, a pulling tie and a tightening tie. The binding frame has a base, a pressing member, two pivot ears, two tie fastening holders and two separating members. The base has a top and two opposite sides. The pressing member is mounted on the top of the base. The pivot ears are mounted respectively on the opposite sides of the base. The tie fastening holders are respectively connected pivotally to the pivot ears and are L-shaped Each tie fastening holder has a lateral segment, a longitudinal segment, a pulling tie hole and a tightening tie hole. The lateral segment is pivotally connected to a corresponding one of the pivot ears. The longitudinal segment is connected to the lateral segment. The pulling tie hole is defined through the longitudinal segment. The tightening tie hole is defined through the lateral segment. The separating members are mounted respectively around the lateral segments of the tie fastening holders to divide the tightening tie hole in a corresponding lateral segment into a first hole segment being adjacent to the corresponding pivot ear and a second hole segment away from the corresponding pivot ear. The pulling tie is mounted through and compressed by the pressing member and has two ends mounted respectively through the pulling tie holes in the tie fastening holders. The tightening tie has two ends mounted respectively through the first hole segments in the tie fastening holders along a first direction, mounted respectively over the separating members and mounted respectively through the second hole segments in the tie fastening holders along a second direction opposite to the first direction.

Other objects, advantages and novel features of the invention will become more apparent from the following detailed description when taken in conjunction with the accompanying drawings.

DETAILED DESCRIPTION OF PREFERRED EMBODIMENT

Figure 1:
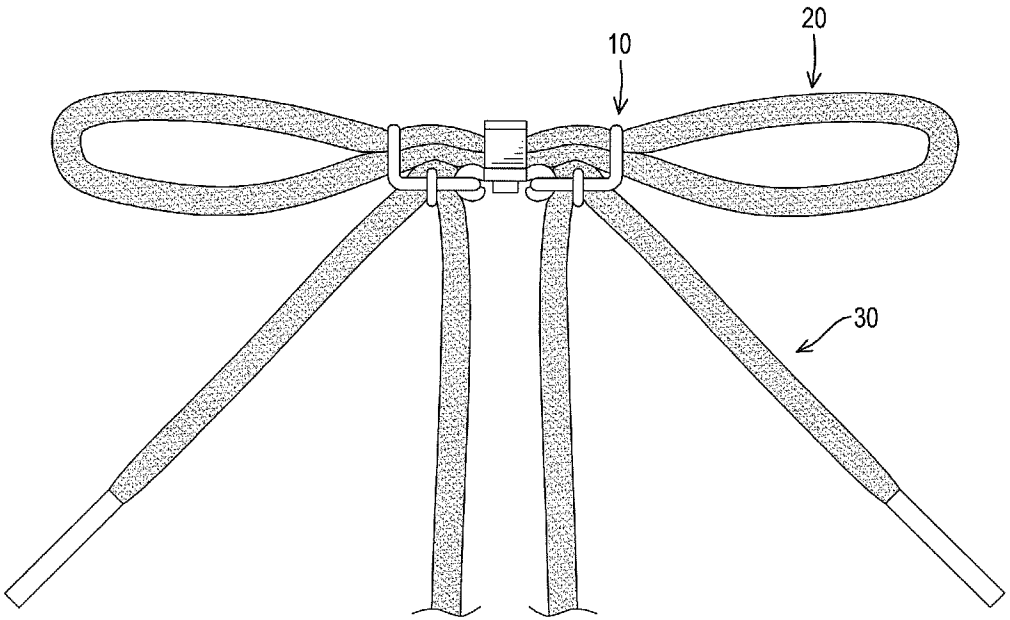
FIG. 1 is a top view of a binding assembly in accordance with the present invention.
Figure 2:
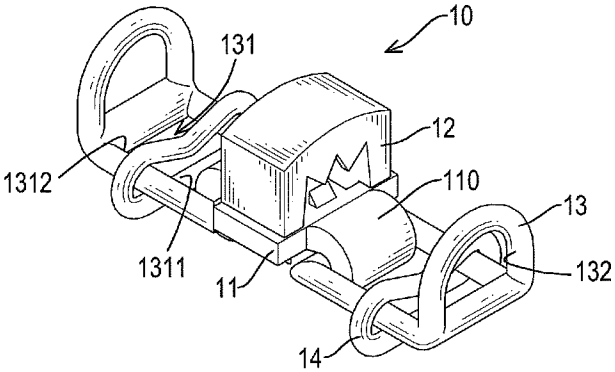
FIG. 2 is an enlarged perspective view of the binding frame of the binding assembly in FIG. 1.

With reference to FIGS. 1 and 2, a binding assembly in accordance with the present invention comprises a binding frame 10, a pulling tie 20 and a fastening tie 30.

Figure 3:
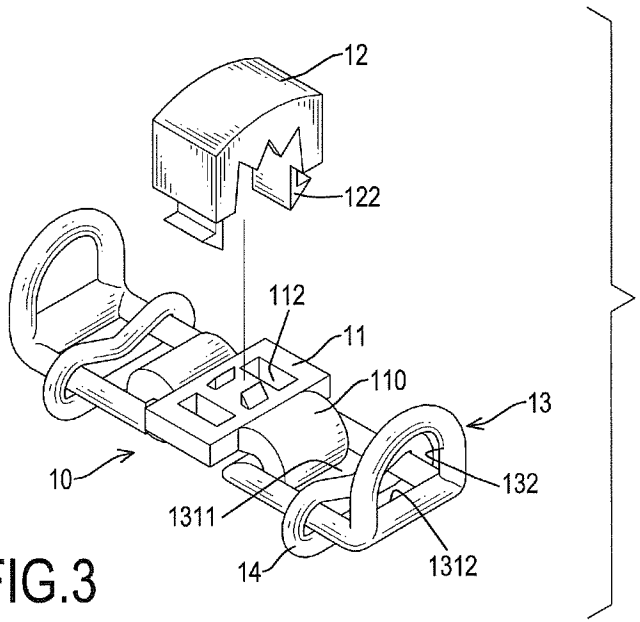
FIG. 3 is an exploded perspective view of the binding frame in FIG. 2.

With further reference to FIG. 3, the binding frame 10 comprises a base 11, two pivot ears 110, a pressing member 12, two tie fastening holders 13 and two separating members 14. The base 11 may be rectangular and has a top, a bottom, two opposite sides and two engaging holes 112. The engaging holes 112 are defined through the base 11. The pivotal ears 110 are respectively mounted on and extend downwardly from opposite sides of the base 11 and may be curved in cross section. The pressing member 12 is mounted on the top of the base 11, may be inversed U-shaped and has two ends and two hooks 122. The hooks 122 are formed respectively on the ends of the pressing member 12, engage respectively the engaging holes 112 in the base 11 and abut with the bottom of the base 11. Accordingly, the pressing member 12 is mounted securely on the top of the base 11.

The tie fastening holders 13 are respectively connected pivotally to the pivot ears 110 and are L-shaped, and each tie fastening holder 13 comprises a lateral segment, a longitudinal segment, a pulling tie hole 132 and a tightening tie hole 131. The lateral segment is pivotally connected to a corresponding one of the pivot ears 110. The longitudinal segment is connected to and substantially perpendicular to the lateral segment. The pulling tie hole 132 is defined through the longitudinal segment. The tightening tie hole 131 defined through the lateral segment.

The separating members 14 are mounted respectively around the lateral segments of the tie fastening holders 13 to divide the tightening tie hole 131 in a corresponding lateral segment into a first hole segment 1311 being adjacent to the corresponding pivot ear 110 and a second hole segment 1312 away from the corresponding pivot ear 110. Preferably, each separating member 14 is annular and has a depression segment formed on a top of the separating member 14.

The pulling tie 20 is mounted through and compressed by the pressing member 12 and has two ends mounted respectively through the pulling tie holes 132 in the tie fastening holders 13. Preferably, the pulling tie 20 is annular and formed as a loop and has a central segment compressed by the pressing member 12 to form two end loops mounted respectively through the pulling tie holes 132 in the tie fastening holders 13.

The tightening tie 30 has two ends mounted respectively through the first hole segments 1311 in the tie fastening holders 13 along a first direction, mounted respectively over the separating members 14 and mounted respectively through the second hole segments 1312 in the tie fastening holders 13 along a second direction opposite to the first direction. Preferably, the ends of tightening tie 30 are mounted respectively through the first hole segments 1311 in the tie fastening holders 13 upwardly and mounted respectively through the second hole segments 1312 in the tie fastening holders 13 downwardly as show in FIG. 1.

Figure 4:
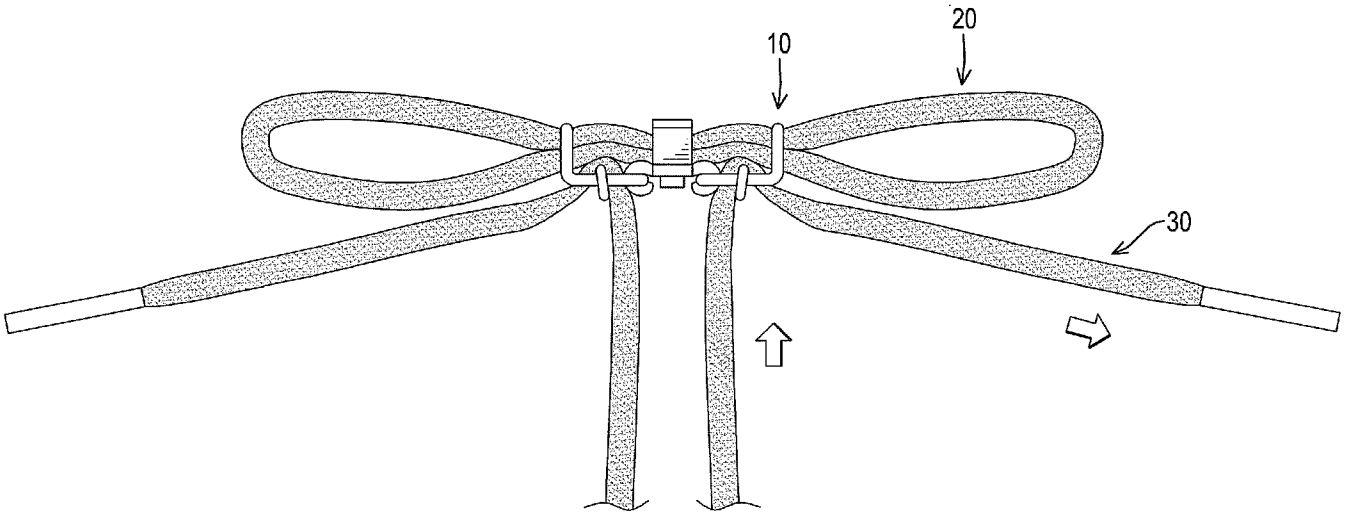
FIG. 4 is an operation top view of the binding assembly in FIG. 1 showing two ends of the tightening tie being pulled.

With reference to FIGS. 2 and 4, when the ends of the tightening tie 30 are pulled outwardly, the tightening tie 30 is pulled to move along the first hole segments 1311 and the second hole segments 1312. Consequently, the tightening tie 30 can be tightened to bind an object.

Figure 5:
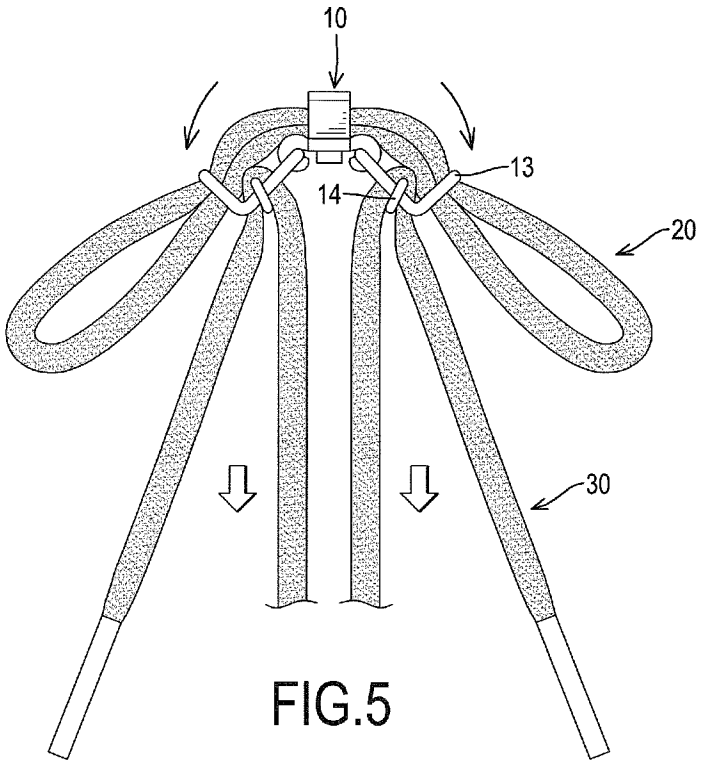
FIG. 5 is an operation top view of the binding assembly in FIG. 1 showing the binding assembly in a tightened condition.

With reference to FIG. 5, when the tightening tie 30 beside the ends is pulled, such as the central segment of the tightening tie 30, the tie fastening holders 13 are pulled to pivot downwardly relative to the base 11. Consequently, the pulling tie 20 is pulled to abut against the tightening tie 30 due to the pivotal rotation of the tie fastening holders 13, such that the tightening tie 30 is kept from being moved relative to the binding frame 10. Thus, the binding assembly will not be released even that the binding frame 10 or the tightening tie 30 is pulled.

Figure 6:
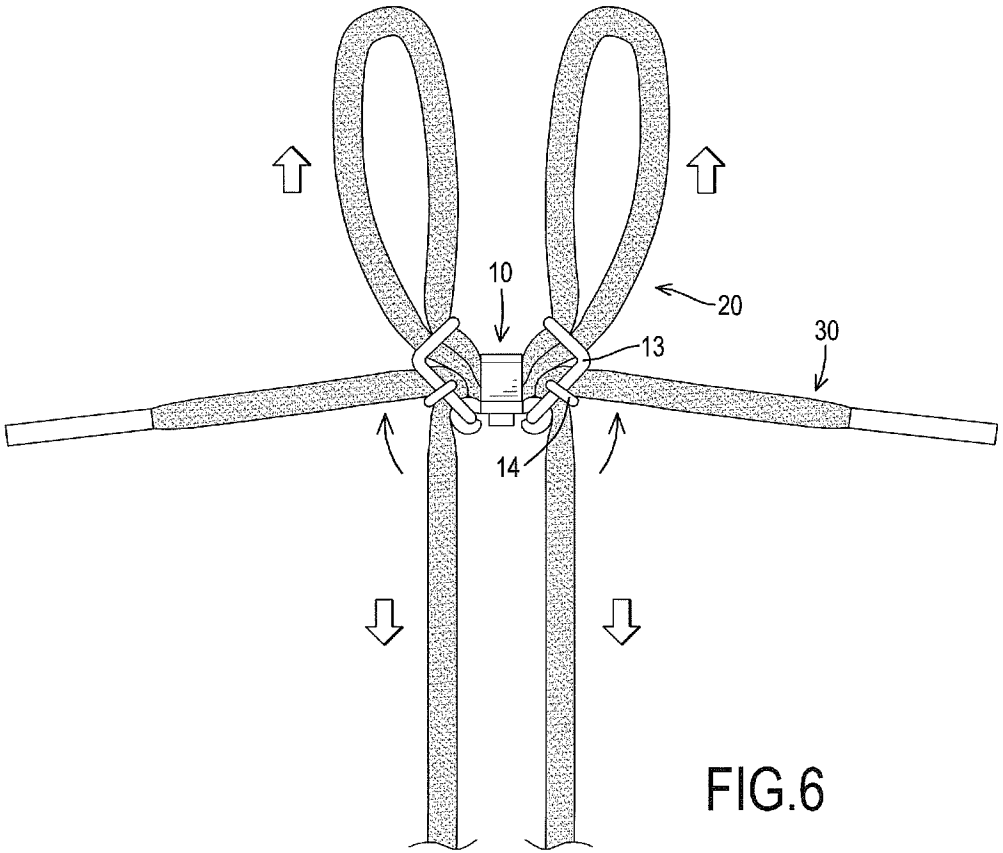
FIG. 6 is an operation top view of the binding assembly in FIG. 1 showing the binding assembly being released by pulling the pulling tie.

With reference to FIG. 6, to release the binding assembly, the end loops of the pulling tie 20 are pulled upwardly and the tie fastening holders 13 are pivoted upwardly to make the central segment of the pulling tie 20 leave from the tightening tie 30. Accordingly, the tightening tie 30 can be moved relative to the binding frame 10, and the binding assembly can be released.

Figure 7:
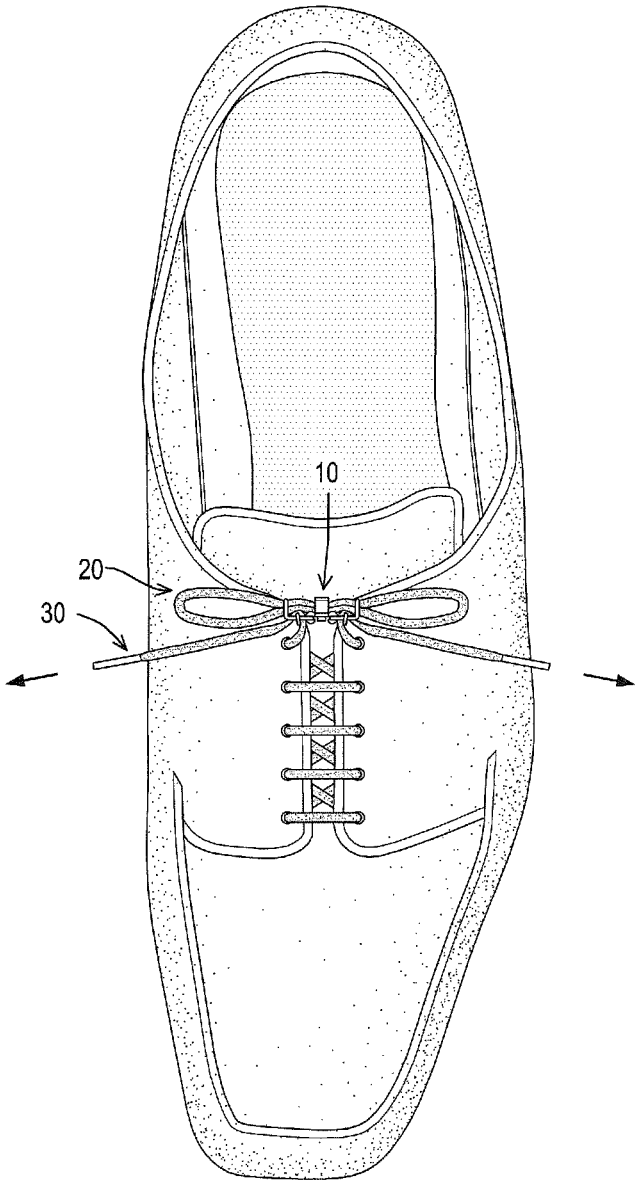
FIG. 7 is an operation top view of the binding assembly in FIG. 1 applied on to a show and showing the binding assembly being tightened.
Figure 8:
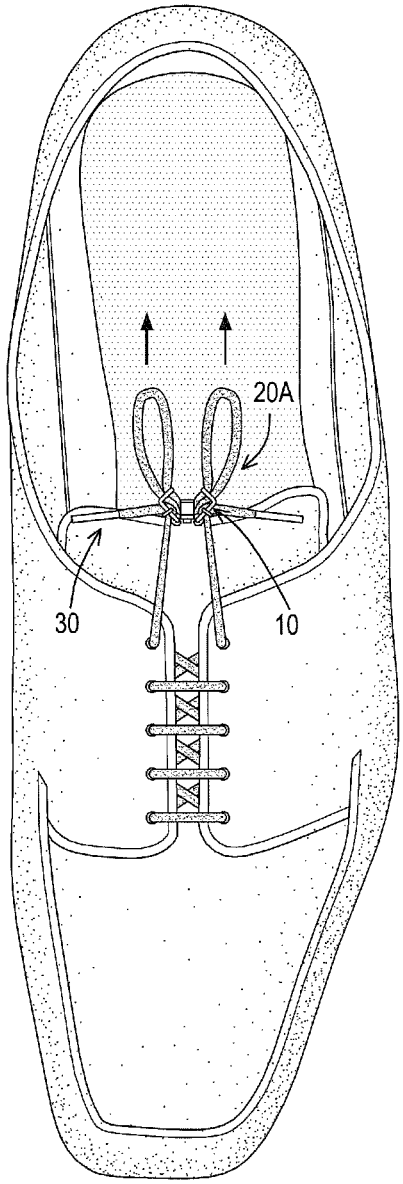
FIG. 8 is an operation top view of the binding assembly in FIG. 1 applied on to a show and showing the binding assembly being released.

With reference to FIGS. 7 and 8, when the binding assembly is applied to a shoe, the shoe can be bound by pulling the ends of the tightening tie 30. With reference to FIG. 8, the shoe can be released easily by pulling the pulling tie 20 away from the shoe. Therefore, to bind or to release a shoe is easy and convenient for a child or a disable person with a single hand.

Figure 9:
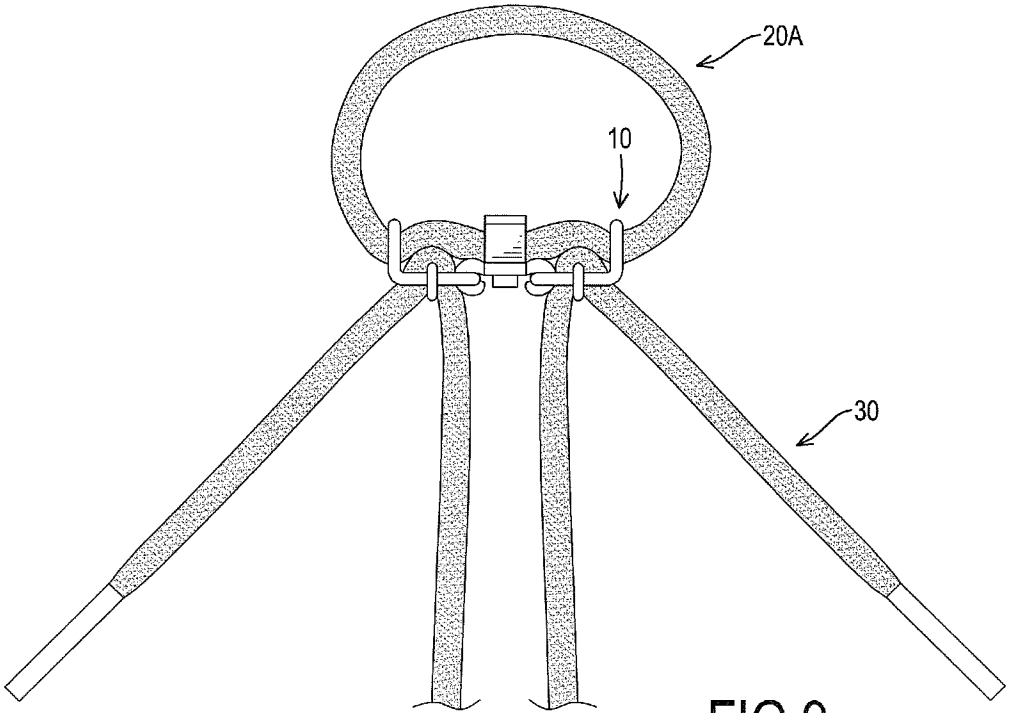
FIG. 9 is a top view of another embodiment of a binding assembly in accordance with the present invention.

With reference to FIG. 9, in another embodiment of the present invention, the pulling tie is a loop 20A mounted through the pressing member 12 and the pulling tie holes 132 in the tie fastening holders 13 as shown in FIG. 2. With pulling the pulling tie 20A, the bind assembly can be released.

Figure 10:
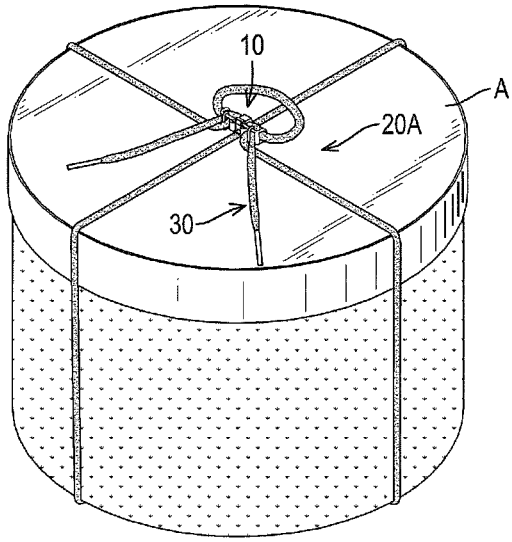
FIG. 10 is an operation perspective view of the binding assembly in FIG. 9 applied on to a cake case.

With reference to FIG. 10, the bind assembly can be applied to bind a cylindrical object A, such as a cake case with the tightening tie 30 mounting around the cylindrical object A. The cylindrical object A can be bound or released easily and rapidly by pulling the ends of the tightening tie 30 or the pulling tie 20A.

Figure 11:
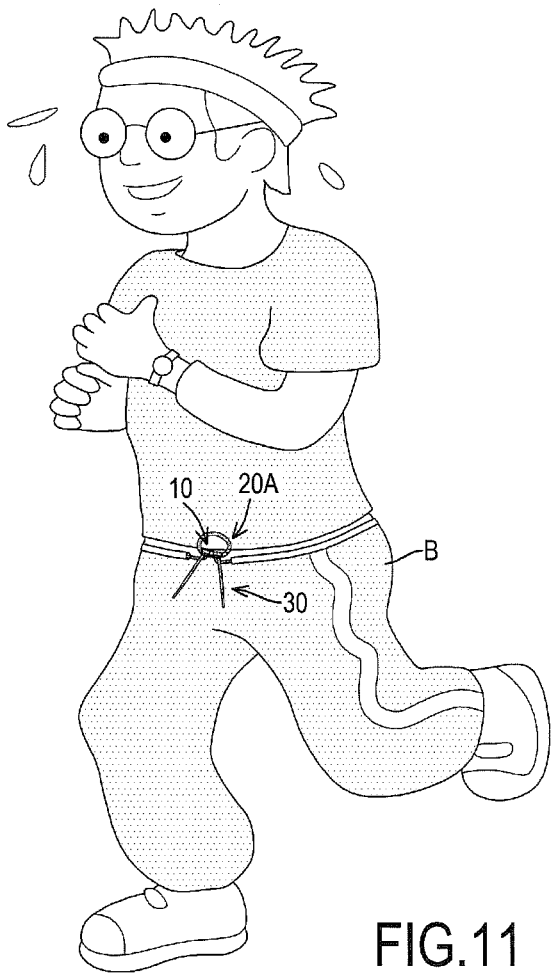
FIG. 11 is another operation perspective view of the binding assembly in FIG. 9 served as a belt.

With reference to FIG. 11, the binding assembly in accordance with the present invention can be served as a belt for a pant B, such that the binding assembly is versatile in use. Furthermore, the pulling tie 30 and the tightening tie 20,20A can be colored in different colors to fit with different needs of use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A binding assembly comprising:

a binding frame comprising a base having a top and two opposite sides;

a pressing member mounted on the top of the base;

two pivot ears mounted respectively on the opposite sides of the base;

two tie fastening holders respectively connected pivotally to the pivot ears and being L-shaped, and each tie fastening holder comprising a lateral segment pivotally connected to a corresponding one of the pivot ears;

a longitudinal segment connected to the lateral segment;

a pulling tie hole defined through the longitudinal segment; and a tightening tie hole defined through the lateral segment; and two separating members mounted respectively around the lateral segments of the tie fastening holders to divide the tightening tie hole in a corresponding lateral segment into a first hole segment being adjacent to the corresponding pivot ear and a second hole segment away from the corresponding pivot ear, wherein each separating member is annular, is formed as a loop that is mounted around a corresponding one of the lateral segments and has a depression segment formed on a top of the separating member;

a pulling tie mounted through and compressed by the pressing member and having two ends mounted respectively through the pulling tie holes in the tie fastening holders; and a tightening tie having two ends mounted respectively through the first hole segments in the tie fastening holders along a first direction, mounted respectively over the separating members and mounted respectively through the second hole segments in the tie fastening holders along a second direction opposite to the first direction.

2. The binding assembly as claimed in claim 1, wherein the base is rectangular and has two engaging holes defined through the base;

the pressing member has two ends and two hooks formed respectively on the ends of the pressing member, engaging respectively the engaging holes in the base and abutting with a bottom of the base.

3. The binding assembly as claimed in claim 2, wherein the pivot ears are curved in cross section.

4. The binding assembly as claimed in claim 3, wherein the pulling tie is annular and has a central segment compressed by the pressing member to form two end loops mounted respectively through the pulling tie holes in the tie fastening holders.

5. The binding assembly as claimed in claim 1, wherein the pivot ears are curved in cross section.

6. The binding assembly as claimed in claim 1, wherein the pulling tie is annular and has a central segment compressed by the pressing member to form two end loops mounted respectively through the pulling tie holes in the tie fastening holders.

* * * * *